US006892487B2

(12) United States Patent
Keigley

(10) Patent No.: US 6,892,487 B2
(45) Date of Patent: May 17, 2005

(54) PERFORATED METAL PICTURE FRAME AND HANGING SYSTEM

(75) Inventor: David Lawrence Keigley, Miami Beach, FL (US)

(73) Assignee: David Keigley, Miami Beach, FL (US)

( * ) Notice: Subject to any disclaimer, the term of this patent is extended or adjusted under 35 U.S.C. 154(b) by 0 days.

(21) Appl. No.: 10/456,294

(22) Filed: Jun. 9, 2003

(65) Prior Publication Data

US 2005/0000131 A1 Jan. 6, 2005

(51) Int. Cl.[7] ..... A47G 1/06

(52) U.S. Cl. ..... 40/700; 40/735; 40/745; 40/772

(58) Field of Search ..... 40/700, 735, 745, 40/757, 761, 772, 773, 768, 611.03, 611.01

(56) References Cited

U.S. PATENT DOCUMENTS

| | | | | | |
|---|---|---|---|---|---|
| 1,809,786 | A | * | 6/1931 | Le Jeune | 40/757 |
| 3,973,343 | A | * | 8/1976 | Tolfsen | 40/790 |
| 5,397,092 | A | * | 3/1995 | Black | 40/745 |
| 5,586,401 | A | * | 12/1996 | Sheehan et al. | 40/737 |
| 5,787,626 | A | * | 8/1998 | Bingham et al. | 40/735 |
| 5,832,646 | A | * | 11/1998 | Albin et al. | 40/762 |

* cited by examiner

*Primary Examiner*—Gary C. Hoge

(57) ABSTRACT

A picture frame and hanging system for hanging and displaying fine art and documents in a level and secure fashion by means of a perforated metal frame covered in acrylic glass with a length and a width and a metal or acrylic C-Rail with a length and a width connected by metal fasteners and metal pins. A first fastener, such as washers, nuts and bolts are provided on the perforated metal frame to attach the acrylic glass to the front of the frame. A second fastener is provided such as metal pins to attach the metal frame to the metal or acrylic C-rail provided. A third fastener is provided such as a L-bracket with holes, in a length and a width to adapt the C-rail to any picture frame needed.

2 Claims, 7 Drawing Sheets

PERFORATED METAL PICTURE FRAME AND HANGING SYSTEM

BACKGROUND OF INVENTION

This invention was created in direct response to the need for a quick functional and visually appealing method of displaying fine art and documents in their entirety. After spending quite some time looking for a system to display my photographs that was functional and a modern work of art in it s own right, I concluded there was nothing on the market and set out to design something for my own use. After building the first prototypes for my own use, I realized that I had stumbled on to a new way of displaying art that could give the consumer a new choice that did not exist. Most framing systems are both very traditional and straightforward in being and have no real esthetically functional qualities. An example of this is the cardboard back with clipped glass system that already exists, you cannot see any frame or hanging system as the entire view is the art itself, which serves its purpose as a low cost frameless choice for consumers but is lacking in the leveling and esthetic arena. Traditional frames and panels must be hung in the usual manner using hooks and wires that require constant leveling and they do not lock onto the wall or surface that has been chosen to display the art.

BRIEF SUMMARY OF THE INVENTION

This invention consist of a sheet of perforated metal, with any size hole perforation or solid face with perforated edges, cut to desired size and bent on all edges to make a return which serves as an ornate edge and a ledge for hanging and connecting the frame to the C-rail system of metal or clear acrylic by the means of metal pins that slide through the perforations in the bent return and then lock into a series of holes drilled into the metal or clear acrylic C-rail system that has been fastened to the desired display structure. The art or document is then sandwiched between the sheet of perforated metal and a sheet of clear acrylic glass, leaving an uncovered portion of perforated metal as a decorative border; the acrylic glass is cut to the size of the frame itself. The sheet of acrylic glass is held in place by metal hardware that consist of various fasteners, preferably bolts, large washers and nuts, the bolts are fed through holes drilled into the glass and the perforations in the metal frame and held in place in the rear of the frame with the bolts and washers. My invention of the perforated metal picture frame and hanging system solves the leveling problem and serves as a great safety feature for hung art both large and small in that it locks to the hanging rail with metal pins. Not only does it meet all these needs it also brings an esthetic quality to the entire frame that is visible from the front of the frame. Until now picture frames, especially large panel ones, had no system like this that locked them to the wall and kept them level in such a secure and visually desirable way.

DETAILED DESCRIPTION OF THE INVENTION

Figure 1:
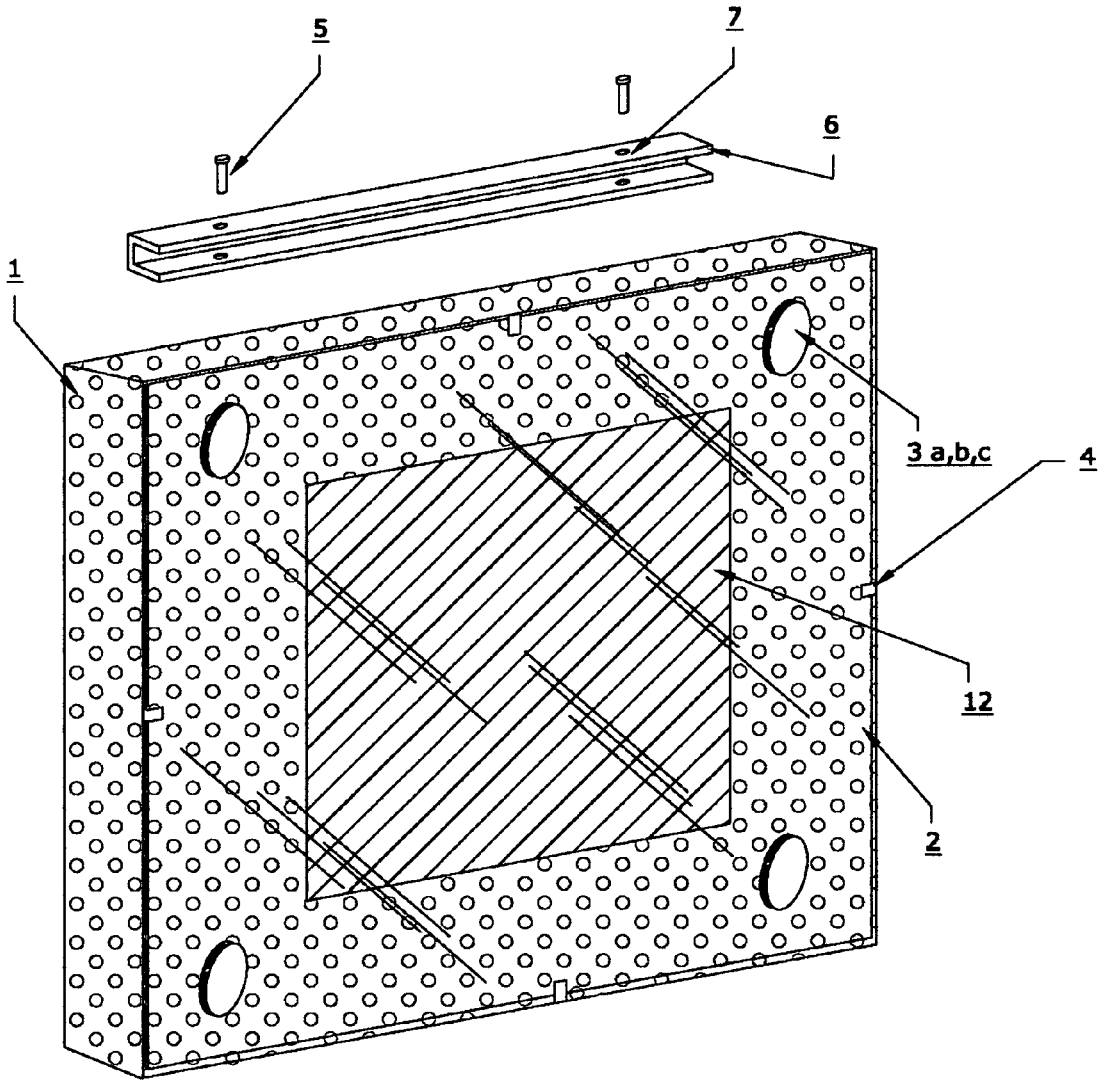
FIG. 1 Is a frontal left facing view of the perforated metal picture frame and hanging system showing the metal C-Rail hanging system and steel locking pins.
Figure 2:
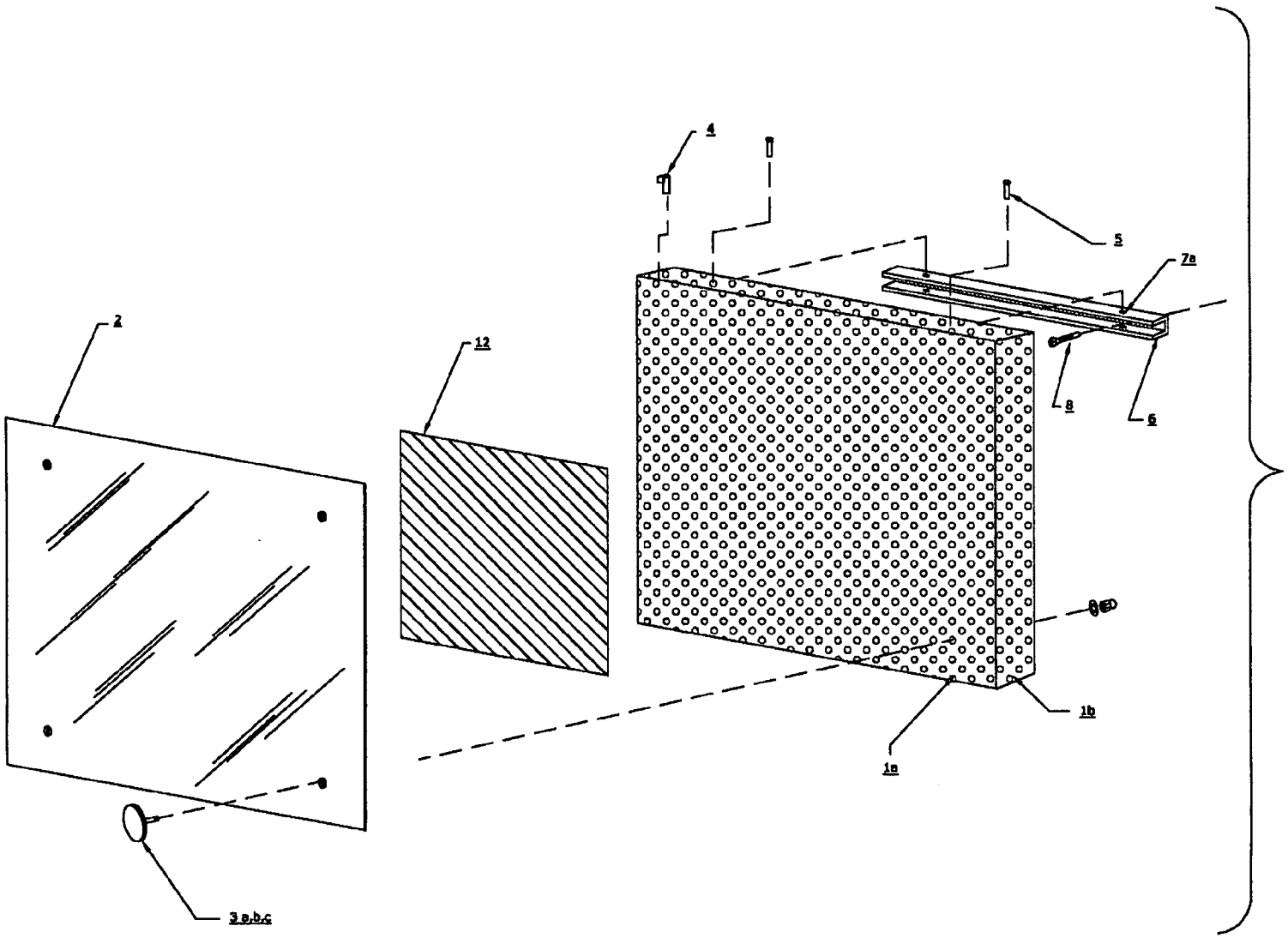
FIG. 2 Is a partial exploded frontal view of the perforated metal picture frame and hanging system showing how the fame is connected to the C-Rail hanging system with the steel pins.
Figure 3:
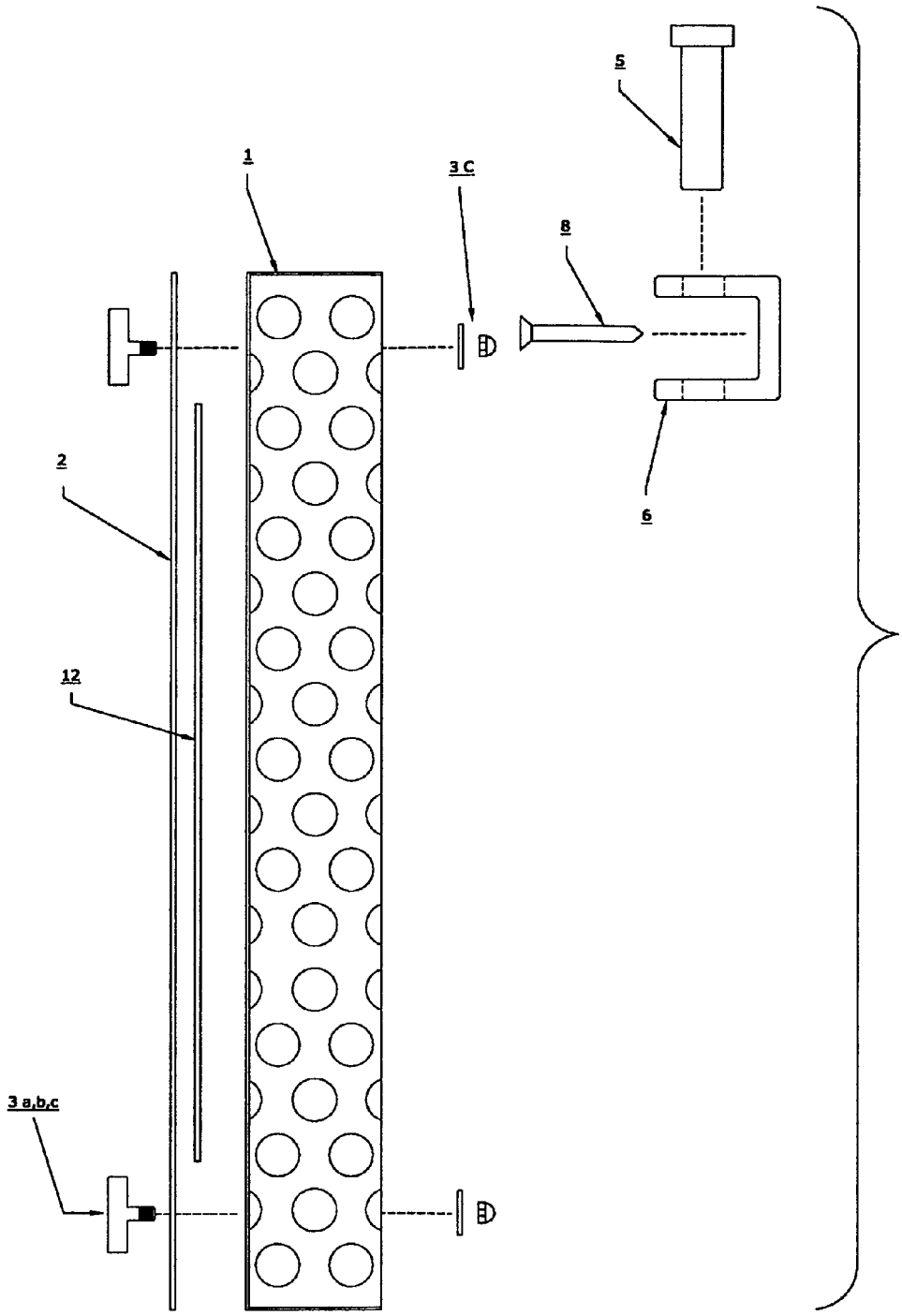
FIG. 3 Is a right side breakaway view of the assembly of the frame and the mounting of the frame to the C-Rail hanging system.
Figure 4:
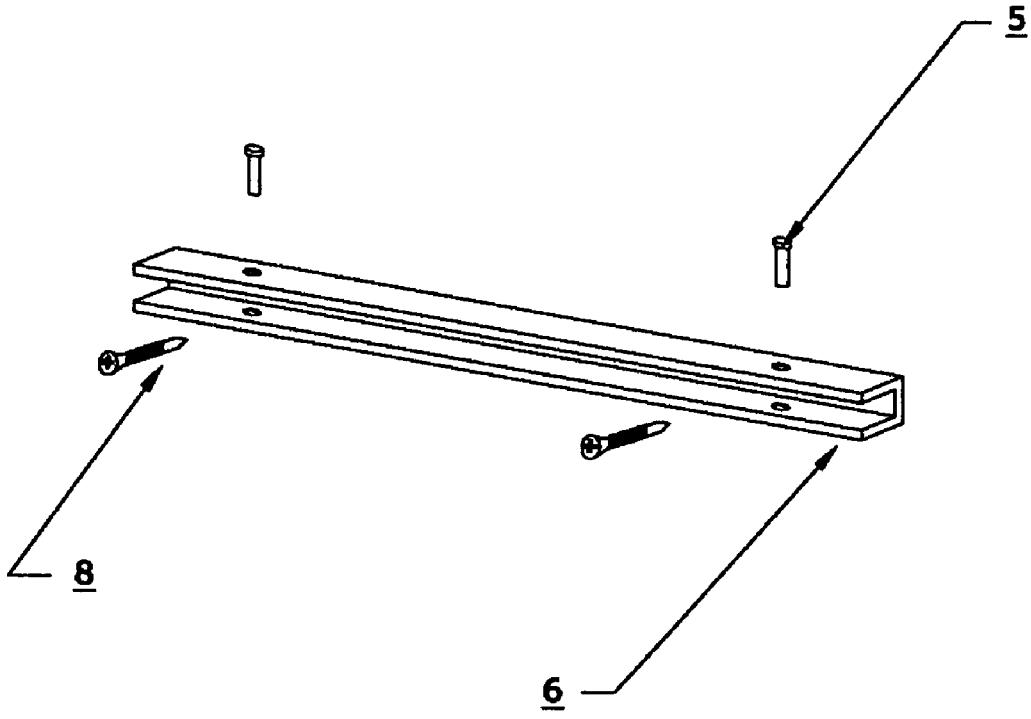
FIG. 4 Is a frontal view of the C-Rail (metal version) hanging system and its components, namely the steel pins that lock the frame to a substrate.
Figure 5:
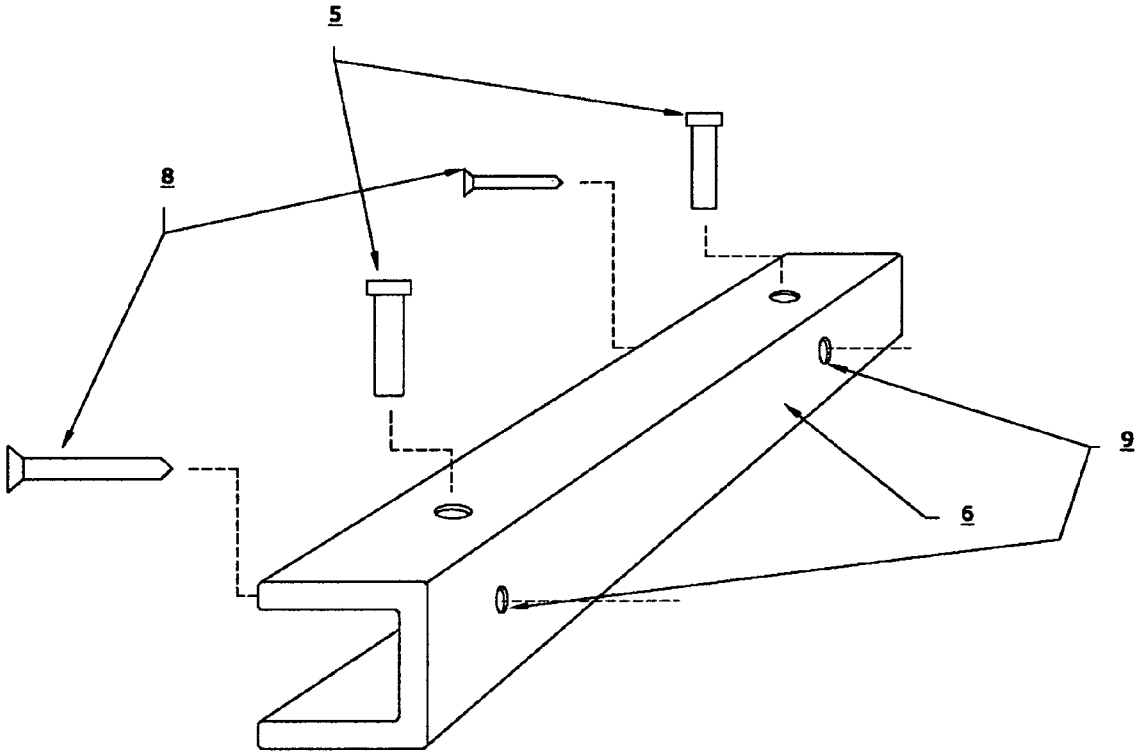
FIG. 5 Is a right side exploded view of the C-Rail (metal version) hanging system and it components.
Figure 6:
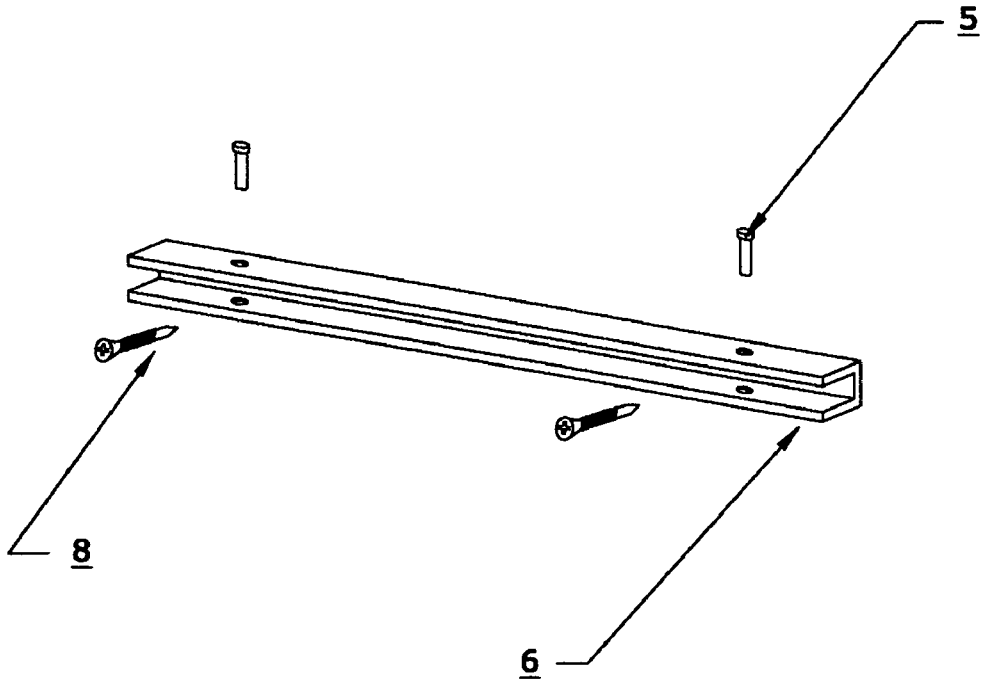
FIG. 6 Is a frontal view of the C-Rail (clear acrylic version) and its hanging components.

Referring to FIGS. 1–6, the perforated metal picture frame consisting of a piece of perforated metal with a front surface (1*a*) formed when a return (1*b*) is made by bending back a portion of the perforated metal sheet and is welded at the corners for strength. The perforated metal frame is then polished with steel wool to bring out a shinny brushed look. A clear piece of acrylic glass (2) is cut to cover the entire frames surface (1*a*); its edges are also polished with steel wool to get rid of the blade marks and give it a refined crystal look. After the acrylic glass (2) is cut and polished the necessary holes are drilled into its surface that will serve as the point where steel fasteners (3*a,b*, c) preferably bolts, washers and nuts will fasten the acrylic glass (2) to the perforated metal frame (1*a*). The consumer will only need to remove the acrylic glass (2) and place the art or documents (12) to be framed over the perforated metal frame (1*a,b*), using a little double stick tape to secure the art, leaving the desired amount of perforated metal frame (1*a,b*) exposed (portion not covered by the art) and then refasten the acrylic glass (2) back to the perforated metal frame (1*a,b*) using the steel fasteners (3*a,b*, c). At which point the C-Rail (6), a C shaped length of polished metal or acrylic that has a series of different size holes drilled into its back, top lip and lower lip, is fastened to a substrate such as a wall by means of screws (8) that are put through the predrilled holes (9), varying in quantity depending on the size of frame used. After which the frame (1*a,b*) is lifted onto the C-Rail (6), where it comfortably rest by means of the frames return (1*b*) on the ledge that is made by fastening the C-Rail (6) to the wall, the perforations (10) in the frame return (1*b*) are then lined up with the holes in the C-Rail (6) and steel pins (5) are inserted through the perforations in the frame (10) and pass through both the upper and lower lip holes (7*a,b*) of the C-rail (6) and lock the frame to the C-Rail (6) and thus to the substrate such as a wall.

Figure 7:
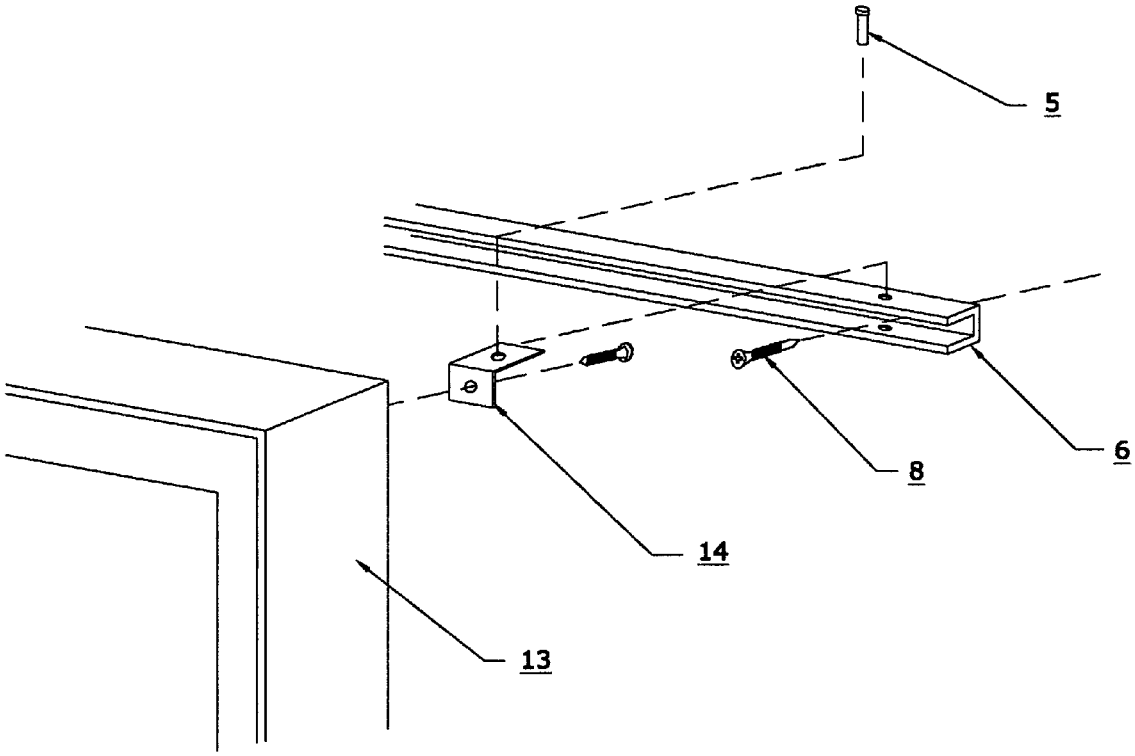
FIG. 7 Is a right side view of the C-Rail and its optional conversion bracket that can be used with any frame to make it compatible with the C-Rail pin system.

Referring to FIG. 7, The C-Rail system (5,6,7*a,b*, 8,9) comes with a pair of L-brackets (14), in various sizes and lengths depending on the frame used, that can be attached with fasteners, preferably screws, to any frame (13) desired so that the C-rail (6) can be adapted to hang, lock and level any frame (13) desired, in the event the consumer chooses to move art from one place to another and wants to continue to use the existing wall mounted C-Rail (6) system with any other frame (13) in their possession. The L-bracket (14) attaches to the C-Rail (6) in the same fashion as the perforated frame (1*a,b*) does by sliding the fastener pins (5) first through the L-brackets holes (15) then through both upper and lower lips (7*a,b*) of the C-Rail (6) locking the frame (13) level and in place.

This frame and hanging system as for mentioned in the background and brief summary portions of this specification really takes art and document displaying to a new level in that it not only is visually appealing but very functional. The perforated metal picture frame and C-Rail hanging system is easy to hang and has a unique C-Rail pin system that safely holds the frame level and in place, thus taking care of the problem of unstable and forever unlevel picture frames and art panel systems.

What I claim as my invention is:

1. An assembly for displaying and connecting, in a level and secure fashion, a piece of art or a document in its entirety to a surface comprising:

a perforated piece of metal having four edges, with a 90 degree bent return on all edges, the perforated piece of metal having a length and a width and a top surface;

a sheet of acrylic having a length, a width and a surface, with mounting holes drilled through the front of said surface;

first fastening means for connecting the acrylic sheet to the perforated piece of metal, after having attached the art or document to be displayed to the perforated piece of metal;

a C-shaped metal or acrylic mounting rail with a length and a width, a back, an upper lip and a lower lip, and having several holes drilled in its back for mounting it to a surface, and a series of holes drilled in the upper lip and lower lip of the C-shaped rail for securing the perforated piece of metal to the C-shaped rail;

second fastening means for connecting the perforated piece of metal to the C-shaped rail, by means of second fasteners put through the perforations in the 90 degree return of the perforated piece of metal then through both sets of holes in the C-shaped rails upper and lower lips.

2. The assembly of claim 1, further comprising:

means for connecting a frame or panel system to the C-shaped metal or acrylic rail;

at least one L-shaped rail bracket having a length and a width, and a tot) face and a back face with holes drilled in both faces;

third fasteners for attaching the L-shaped rail bracket, by means of holes drilled in the back face of the L-shaped rail bracket, to a surface to be attached to the C-shaped rail;

fourth fasteners, used to connect the L-shaped rail bracket mounted structure to the C-shaped rail by means of the fourth fasteners being slid through the holes drilled in the top face of the L-shaped rail bracket and then down through both holes in the C-shaped rails upper and lower lips.

* * * * *